US007494012B1

(12) United States Patent
Priebe et al.

(10) Patent No.: US 7,494,012 B1
(45) Date of Patent: Feb. 24, 2009

(54) LOCKABLE PILL CONTAINER

(75) Inventors: Robert N. Priebe, Bloomington, MN (US); Terrance O. Noble, Burnsville, MN (US)

(73) Assignee: Apothecary Products, Inc., Burnsville, MN (US)

( * ) Notice: Subject to any disclaimer, the term of this patent is extended or adjusted under 35 U.S.C. 154(b) by 696 days.

(21) Appl. No.: 11/066,966

(22) Filed: Feb. 25, 2005

(51) Int. Cl.
*B65D 83/04* (2006.01)

(52) U.S. Cl. ..... 206/538; 206/1.5; 292/175; 292/150

(58) Field of Classification Search ..... 206/1.5, 206/538, 528; 292/137, 163, 164, 175, 138, 292/145, 146, 150, DIG. 4, DIG. 11, DIG. 37
See application file for complete search history.

(56) References Cited

U.S. PATENT DOCUMENTS

| | | | | |
|---|---|---|---|---|
| 3,429,604 | A * | 2/1969 | Reitzel | 292/175 |
| 4,865,368 | A * | 9/1989 | McCall et al. | 292/175 |
| 5,379,899 | A * | 1/1995 | Thurell | 206/538 |
| 6,000,546 | A | 12/1999 | Noble | |
| 6,157,532 | A * | 12/2000 | Cook et al. | 361/681 |
| 6,299,223 | B1 * | 10/2001 | Ji et al. | 292/175 |
| 6,988,618 | B2 * | 1/2006 | DeJonge | 206/528 |
| 2005/0098455 | A1 * | 5/2005 | Hsiao et al. | 206/308.2 |
| 2006/0261600 | A1 * | 11/2006 | Lee | 292/175 |

OTHER PUBLICATIONS

Apothecary Products, Inc. Locking Container—2XL-14COMP, U.S. Appl. No. 6,000,546.
Apothecary Products, Inc. Adult Lock™ Pill Reminder- 3XL; available prior to Feb. 25, 2005; 4 pages.
Apothecary Products, Inc. Adult Lock™ Pill Reminder- XL; available prior to Feb. 25, 2005; 4 pages.
Apothecary Products, Inc. EZY Dose® Adult-Lock™ Weekly Pill Reminder- Large; available prior to Feb. 25, 2005; 4 pages.

* cited by examiner

*Primary Examiner*—Jacob K Ackun, Jr.
(74) *Attorney, Agent, or Firm*—Merchant & Gould P.C.

(57) ABSTRACT

A lockable pill container includes a main body defining a plurality of compartments, and a plurality of lid members that are moveable relative to the compartments between a closed position at least partially covering an opening into the compartments and an open position. Each lid member includes a first engagement member that extends into the main body when the lid member is in the closed position. The container also includes an elongate second engagement member configured to move between a first position engaging the first engagement members and a second position disengaged from the first engagement members. A biasing member is positioned between a first end of the second engagement member and the main body to provide a biasing force that biases the second engagement member into the first position. The second engagement member also includes a contact surface at a second end thereof for engagement by a user to move the second locking member against the biasing force.

20 Claims, 13 Drawing Sheets

100
104
105
107
109
110
111
113
114
115
118
119
121
122
124
125
126
128
130
134
136
138
150
6

LOCKABLE PILL CONTAINER

BACKGROUND OF THE INVENTION

1. Field of the Invention

The present invention relates generally to storage containers and is specifically directed to a pill container with a lockable feature and related methods.

2. Related Art

For persons who need to take medicine regularly, the need for a pill container that can be easily carried is highly important. A pill container that is easy to use, has sufficient capacity for the patient's needs, and which can be conveniently carried by the user increases the likelihood that the user will take the correct medicine at the correct time.

Some pill containers are provided with child restraints in the form of locking mechanisms. It is important that a child restraint locking mechanism is durable and that it provide a reliable restraint against children inadvertently opening the pill container. On the other hand, the child restraint should not present increased difficulties for people with, for example, limited ability to use the pill container. That is, pill containers that include minute controls for child restraint and/or lids that must be gripped with fingertips to open often present increased handling difficulties for people suffering from, for example, rheumatism or arthritis. Many patients who responsibly keep their pill container away from children may prefer that the child restraint be removed, enabling the device to be accessed more easily.

In many pill containers, the user opens a lid, cover or equivalent structure to access a compartment that contains the medicine that is about to be taken. Because the opening of the compartment is typically so small that the patient cannot conveniently take out the medicine tablets with one or two fingers, or at least cannot do so without destroying one or more of the medicine tablets, the patient may cup his or her hand over the opening of the compartment and turn the medicine storage device upside down, hoping to catch the medicine tablets in the cupped hand.

Known pill containers also frequently include multiple storage compartments with each compartment corresponding to a different day of the week. It is also common to put symbols or numbers written in Braille on the medicine storage device to aid a visually impaired patient in taking his or her medicine on the right day.

SUMMARY OF THE INVENTION

The present invention generally relates to generally to pill containers and is specifically directed to a pill container with a lockable feature. On aspect of the invention relates to a lockable pill container that includes a main body, a lid member, and first and second locking members. The main body defines a plurality of separate compartments that each have an open top. A lid member is associated with each compartment. The lids are sized and constructed to overlie the open top of the associated compartment. The lids include an engageable first locking member that is sized and constructed to project into the main body when the lid member is in its closed position. The second locking member carried by the main body and moveable between a first position in which the second locking member interlockably engages the first locking members of closed lid members, and a second position in which the second locking member is disengaged from the first locking members. The second locking member includes a biasing member that is coupled at one end of the second locking member and a user engagement surface at an opposing end. The user engagement surface is configured for engagement by a user to move the second locking member between the first and second positions, whereby moving the second locking member includes engaging the biasing member. The biasing member provides biasing forces to bias the second locking member into the first position.

Another aspect of the invention relates to a method of forming a lockable pill container. The method includes forming a main body having a plurality of separate compartments, each compartment having an open top, and forming a lid member for each of the compartments, wherein each lid member is sized and constructed to overlie the open top of the associated compartment. The lid member also includes an engageable first locking member that is sized and constructed to project into the main body when the lid member is in a closed position. The method also includes positioning a second locking member at least partially within the main body and moveable between a first position in which the second locking member interlockably engages the first locking members of closed lid members, and a second position in which the second locking member is disengaged from the first locking members. The method yet further includes coupling a biasing member at a first end of the second locking member, the biasing member biasing the second locking member into the first position, and forming an engagement surface at a second end of the second locking member. The engagement surface is configured for engagement by a user to move the second locking member between the first and second positions thereby actuating the biasing member.

Another method according to principles of the present invention relates to using a lockable pill container. The method includes providing a main body having a plurality of compartments, a plurality of lid members, a first locking member associated with each lid member, and a second locking member having a biasing member coupled at one end and an engagement surface at an opposing end. The method also includes closing at least one of the lids to engage the first and second locking members, engaging the engagement surface to move the second locking member against the biasing forces of the biasing member, thereby disengaging the first and second locking members, and opening the at least one lid.

BRIEF DESCRIPTION OF THE DRAWINGS

The invention may be more completely understood in consideration of the following detailed description of various embodiments of the invention in connection with the accompanying drawings, in which.

Figure 1:
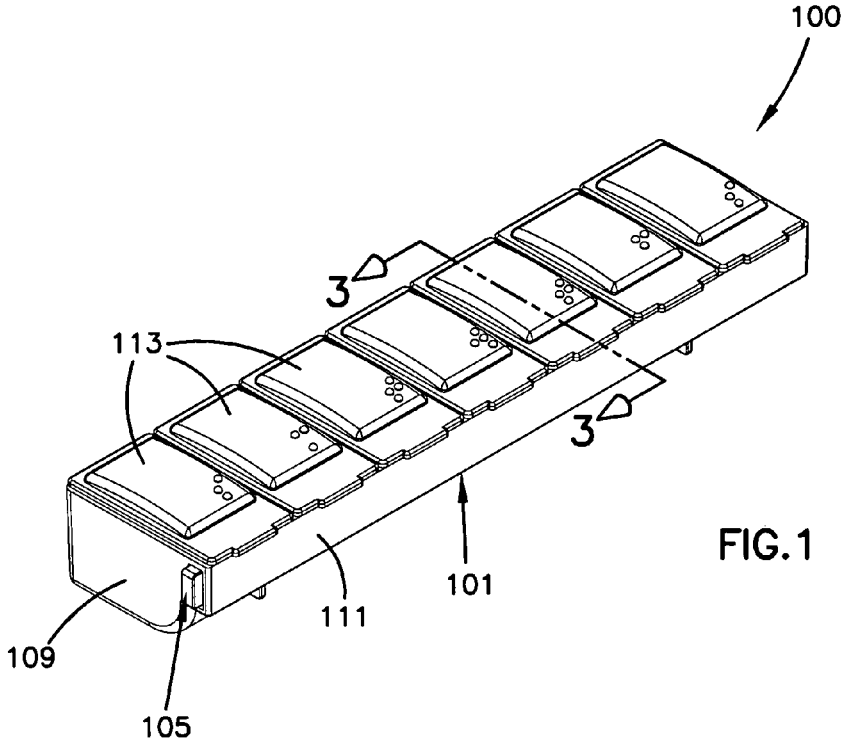
FIG. 1 is a perspective view of an example seven-compartment storage device according to principles of the present invention.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to portable storage devices such as portable pill containers. More specifically, the present invention relates to locking devices and related methods of locking a portable storage device.

FIGS. 1-7 illustrate various features and views of an exemplary portable storage device 100 in the form of a seven compartment pill container. The device 100 includes a main body 101 and a longitudinally extended locking engagement member 105. The main body 101 includes a bottom element 107, a first side element 109, a second side element 110, a front member 111, a top member 112 and a plurality of lid members 113. The main body 101 and the engagement member 105 as well as the various parts that they include may be manufactured from a number of different materials. For example, many plastic materials, such as polyethylene may be used with embodiments of the invention. The parts of the device may all be manufactured using well-known techniques such as, for example, plastic injection molding.

Inside the main body 101, a plurality of dividing elements 108 are located, thus forming a plurality of separate pill storage compartments 118 in the main body 101. In a preferred embodiment, the compartments are disposed linearly in rows or in a matrix of rows and/or columns of compartments, further examples of which are shown in the Figures and described below.

Each of the plurality of lid members 113 is constructed and sized to close one of the separate compartments 118. Each lid member 113 includes a hook member 115 extending perpendicularly beneath the lid member 113. The hook members 115 are engageable by the locking engagement member 105 to lock the lid members 113 in a closed position. Likewise, by moving the locking engagement member 105, the hook members 115 are disengaged from the locking engagement member 105 so that the lids can move to an open position.

The longitudinally extended engagement member 105 includes first and second ends 122, 124, a transverse portion 125 extending from the first end 122 and defining an engagement surface for engagement by a user, and a biasing member engagement structure 126 extending from the second end. The transverse portion 125 extends substantially perpendicular to the direction along the length of the engagement member 105. The transverse portion 125 may be a relatively rigid member that is shaped as a "button" type member with any desired cross-sectional shape (e.g., rectangular, oval, circular, etc.). The transverse portion 125 may also be referred to herein as an activating or engaging member. The engagement member 105 is insertable into the main body 101 through an opening 116 in the first side element 109. When inserted into the main body 101, the engagement member 105 can engage and disengage the hook members 115 of the lid members 113 to hold at least one lid member 113 in a closed position. The engagement member 105 may fit within a recessed portion 120 that is formed in the first side element 109. The configuration of the engagement member 105 has at least the advantage that it does not encroach upon the space of any of the compartments in the main body.

Figures 3, 4, 5:
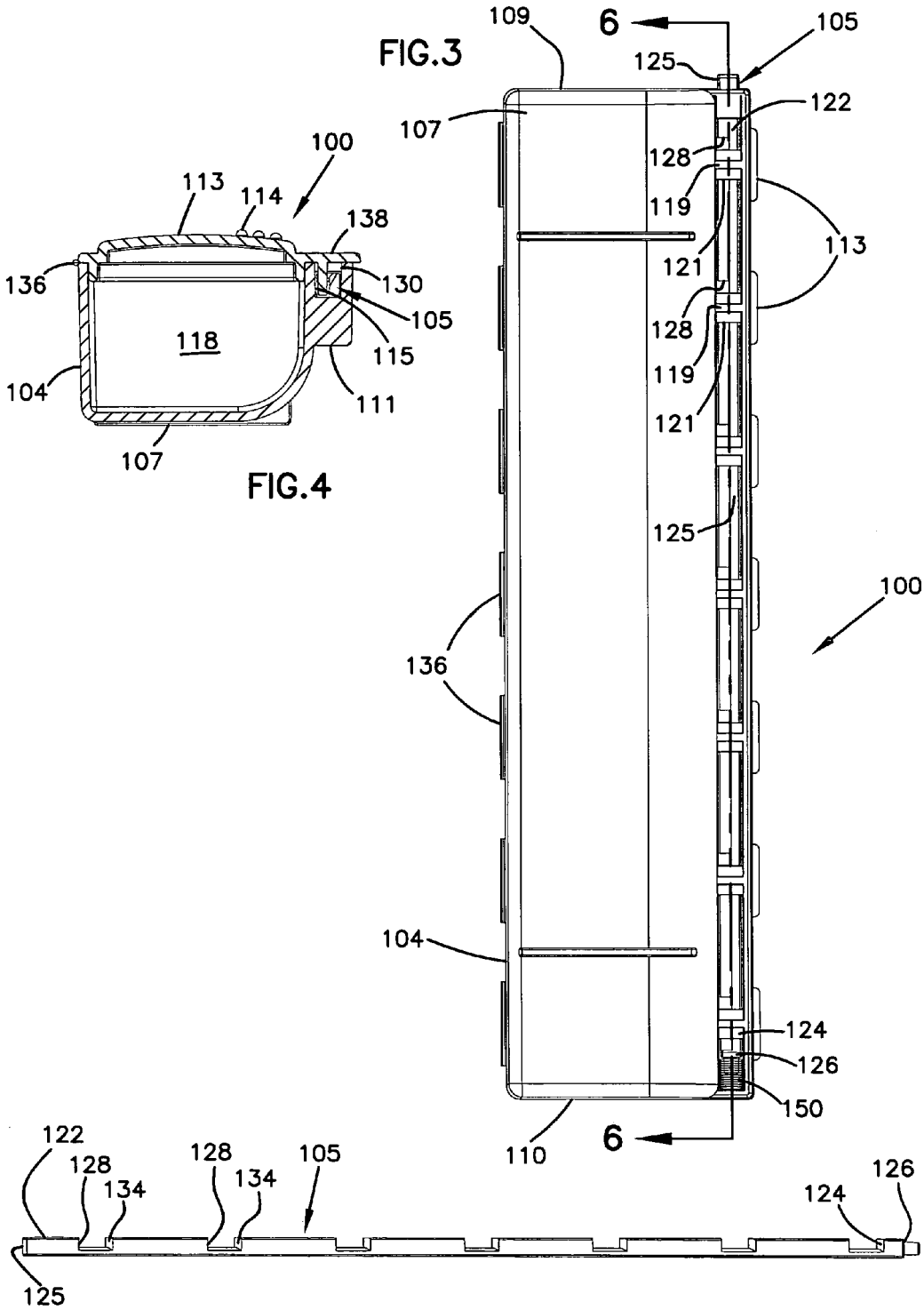
FIG. 3 is a bottom view of the storage device shown in FIG. 1.
FIG. 4 is a cross-sectional view of the storage device shown in FIG. 1 taken along cross-sectional indicators 4-4.
FIG. 5 is a top view of the engagement member shown in FIG. 2.
Figure 6:
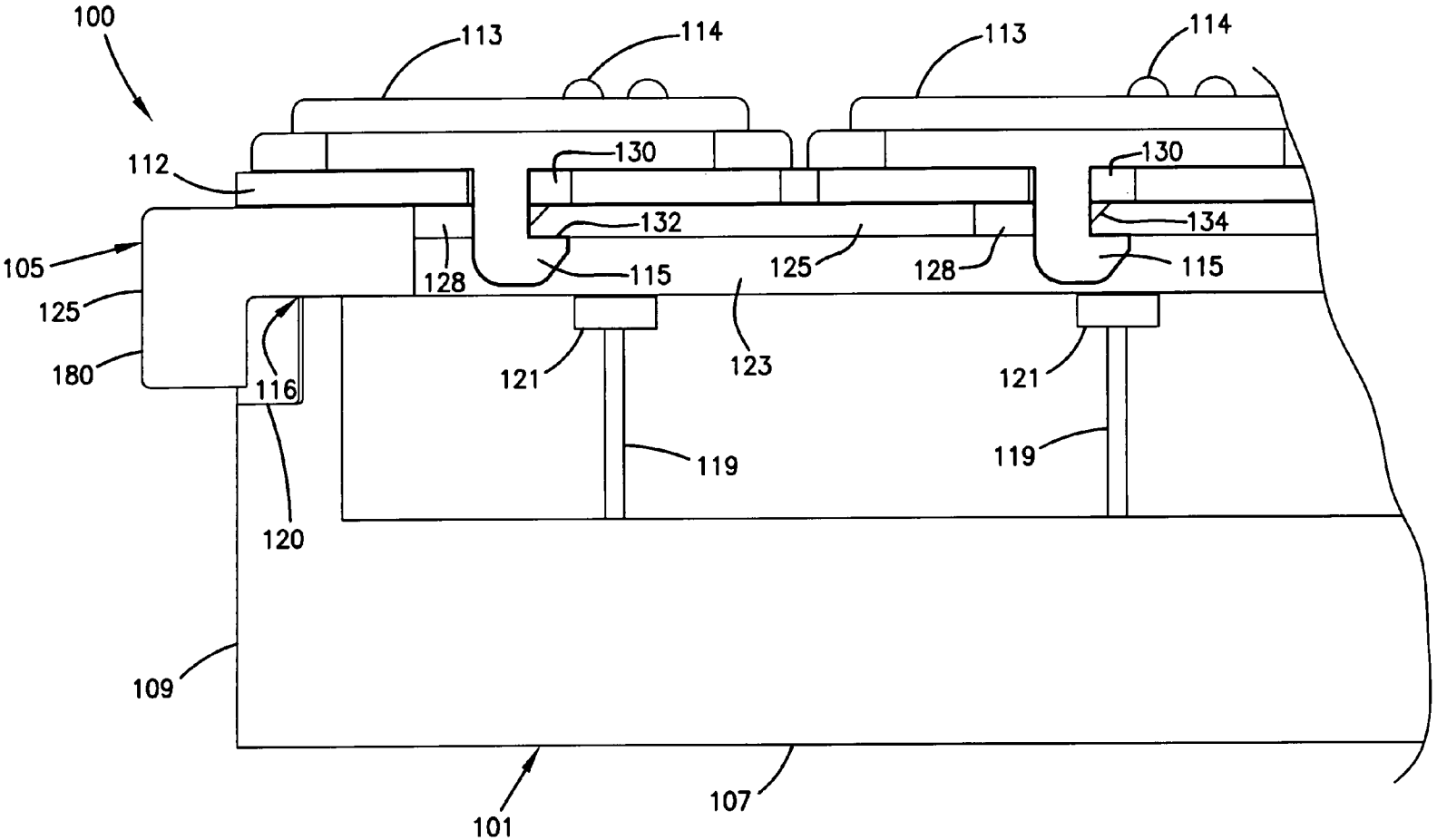
FIG. 6 is a side view of the storage device shown in FIG. 1 with the engagement member engaging the lid locking features.
Figure 7:
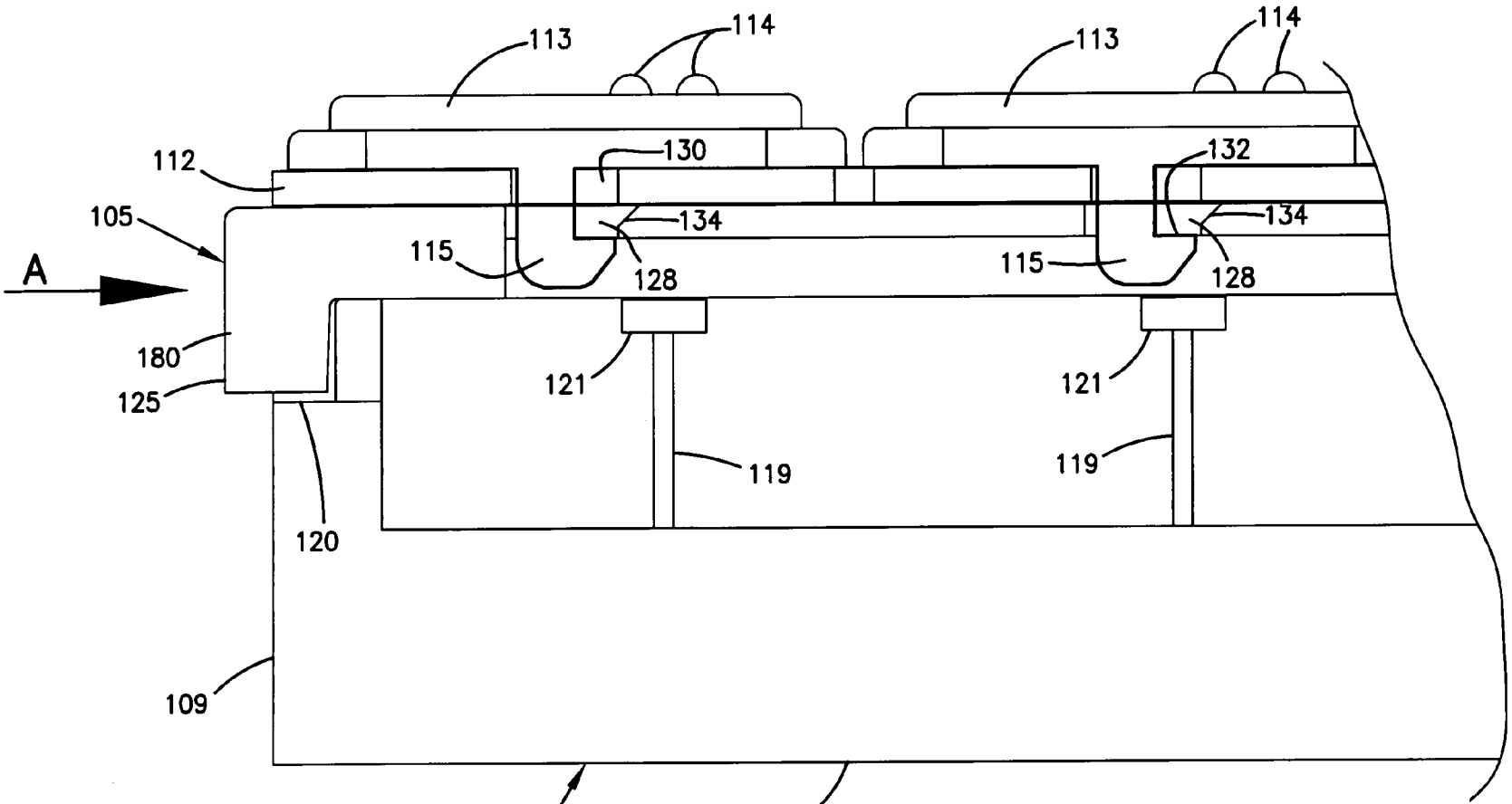
FIG. 7 is a side view of the storage device shown in FIG. 1 with the engagement member disengaged from the lid locking features.

The engagement member 105 is supported within opening 116 by a plurality of support platforms 121 (see FIGS. 3, 6 and 7). Support ribs 119 support the platforms 121. The shape of the platforms 121 and ribs 119 may vary slightly for purposes of molding the platforms 121 and ribs 119 directly into the main body 101.

FIGS. 6 and 7 illustrate partial cross-sectional views of the device 100 with two lid members 113 in the closed position. Each lid member 113 closes a separate compartment 118 in the main body, and the separate compartments 118 are separated from each other by dividing elements 108. Upwardly extending bumps 114 formed on the lid members 113 may be symbols and/or numbers written in Braille for visually impaired users of the device.

When the lid members 113 are in the closed position, the hook members 115 extend through top openings 130 in the front member 111 of the main body. The hook members 115 also extend through gaps or openings 128 formed in the front edge of engagement member 105. Engagement edges 132 of the hook members 115 engage the bottom surface of transverse portion 125 of the engagement member 105, retaining or locking the lid members 113 in the closed position. A biasing member 150 is positioned within the opening 116 in engagement with the biasing member engagement structure 126. The biasing member 150 may either act in compression or in tension to provide a biasing force against the engagement member 105 in a direction along the length of the engagement member 105. This biasing force maintains the engagement member 105 in the extended first position shown in FIG. 6. In other embodiments, the biasing member 150 may be configured to maintain the engagement member 105 in a retracted second position shown in FIG. 7.

Figure 2:
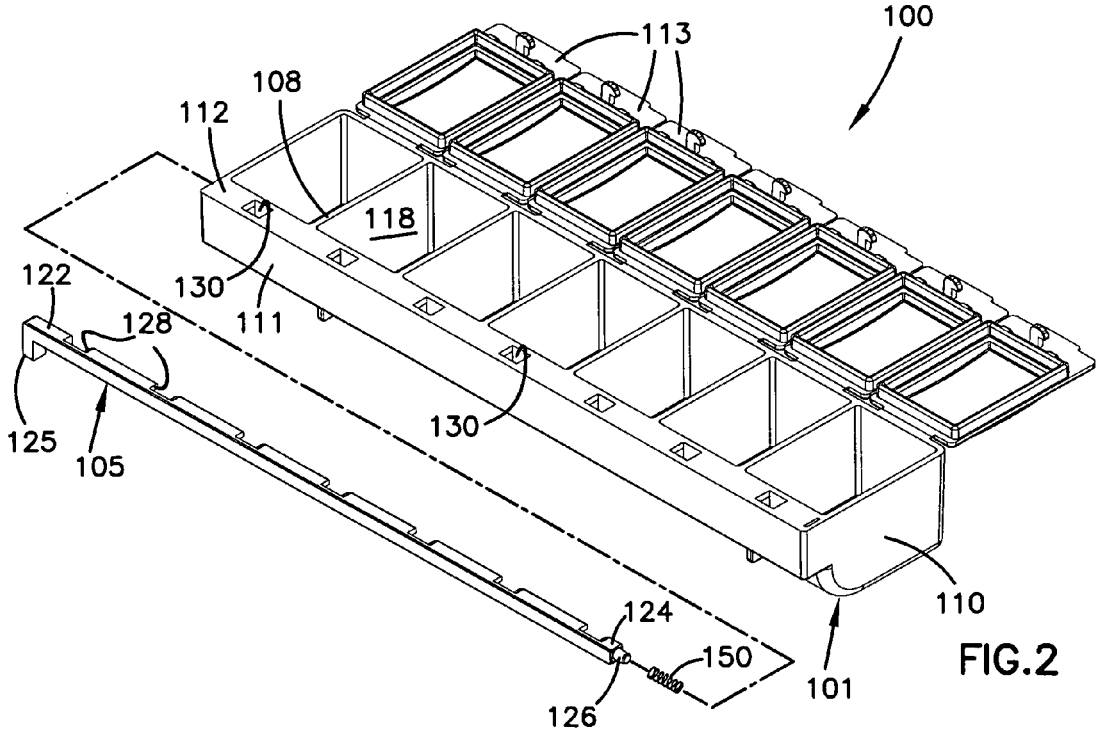
FIG. 2 is an exploded perspective view of the storage device shown in FIG. 1.

In the state shown in FIG. 6, the engagement member 105 acts as a child restraint or locking mechanism for the device. The lid members 113 cannot be opened with the engagement member 105 in its present position, due to the locking engagement between the engagement edges 132 of the hook member 115 and the engagement portion 132 of the engagement member 105. As shown in FIG. 2, the openings 128 are slightly horizontally offset from the openings 130. Each hook member 115 is therefore constrained by the left boundary of the opening 130 and by the right boundary of the opening 128, thus holding the lid member 113 in a closed position.

In order for the hook member 115 to be released from the locking engagement, the openings 128 and 130 must be aligned substantially vertically, so that the hook member 115 is no longer held in the locking engagement position and the lid member 113 can be opened. The right boundary of the opening 128 engages the hook member 115 and thus prevents the engagement member 105 from being laterally withdrawn out of the main body of the device. Furthermore, the biasing member 150 biases the engagement member 105 to the extended first position shown in FIG. 6. However, as will be discussed below, applying a moderate pressure to an engagement surface 180 (see FIGS. 6 and 7) of the transverse portion 125 causes the biasing member to be compressed, and the locking mechanism may thus be released permitting the lid members 113 to be opened.

Referring now to FIG. 7, a moderate amount of force is shown applied to the transverse member 125, as indicated by the arrow 301. This causes the engagement member 105 to project laterally into the opening 116 of the main body 101. This movement compresses the biasing member 150 that is positioned at the second end 124 of the engagement member 105. Preferably, a typical user of the device should be able to exert a sufficient amount of force on the engagement surface 180 of the transverse member 125 with one finger to compress the biasing member 150 while still holding the device. When pressure is applied to the engagement member 105 as indicated, the lateral movement of the engagement member 105 causes the openings 128 and 130 to be in a relatively more vertically aligned position than otherwise. When this occurs, the engagement edge 132 of the hook member 115 no longer engages the engagement portion 125 of the engagement member 105. Thus, the hook member 115 can be withdrawn from the openings 128 and 130. As will be further described below, it is preferable that a relatively small amount of force be used to open the lid members 113 when the engagement member 105 is in its nonlocking position and the hook members 115 are unrestrained or unlocked.

A ramp portion 134 is formed at the right boundary of each of the openings 128 in the engagement member 105. When the lid members 113 are in an open position and the engagement member 105 is in its normal locking position, the ramp portion 134 facilitates the closing of the lid members 113 and the activation of the child restraint or locking mechanism. When the lid member 113 is being closed, the hook member 115 approaches the openings 128 and 130 from above. On its way down through the opening the hook member 115 engages the ramp portion 134. The force needed to close the lid members 113 is a moderate force that can easily be applied by a typical user of the device, and may be of substantially the same magnitude as the force necessary compress the biasing member 150 as described above. When the hook member 115 has passed sufficiently far through the opening 128, the engagement between the hook member 115 and the ramp 134 will cease. The engagement member 105 will then return to its original position due to the resilience of the transverse portion 125. In doing so the engagement edge 125 will engage the engagement face 132 of the hook member 115, thereby activating the locking mechanism. The engagement between the engagement edge 125 and the engagement face 132 will continue until the engagement member 105 is again dislocated by a person deactivating the locking mechanism.

With all lid members 113 in open positions, the user may remove the engagement member 105 by withdrawing it from the opening 116. In this manner the locking mechanism is disabled but it can be restored by reinsertion of the engagement member 105. The engagement member 105 or main body 101 may be configured with some structure or feature that helps to maintain the engagement member 105 in the inserted position. Some example features include a snap or interference fit, temporary coupling of the biasing member to the engagement member 105 and the to the main body 101, etc.

It should be noted that although the lid members 113 are all shown in the same opened or closed positions in the Figures, the lid members 113 are individually movable and can assume closed or open positions independently of each other. The lid members 113 are connected to the back element 104 of the main body 101 with hinge members 136, which in the preferred embodiment are living or integral hinges formed by the injection molding process. Each lid member 113 is provided with an extended portion 138. The extended portion 138 is disposed on the opposite edge of the lid member 113 in relation to the hinge member 136. The extended portion 138 is slightly narrower than the rest of the lid member 113 to facilitate its selective engagement. When the lid member 113 is in a closed position, the extended portion 138 will extend slightly over the front member 111. This provides the user of the device with a good grip against which pressure can be applied using, for example, the thumb or another finger, whereby the desired lid member 113 can be opened. The openings 130 are disposed along the top front edge of top member 112.

Figure 8:
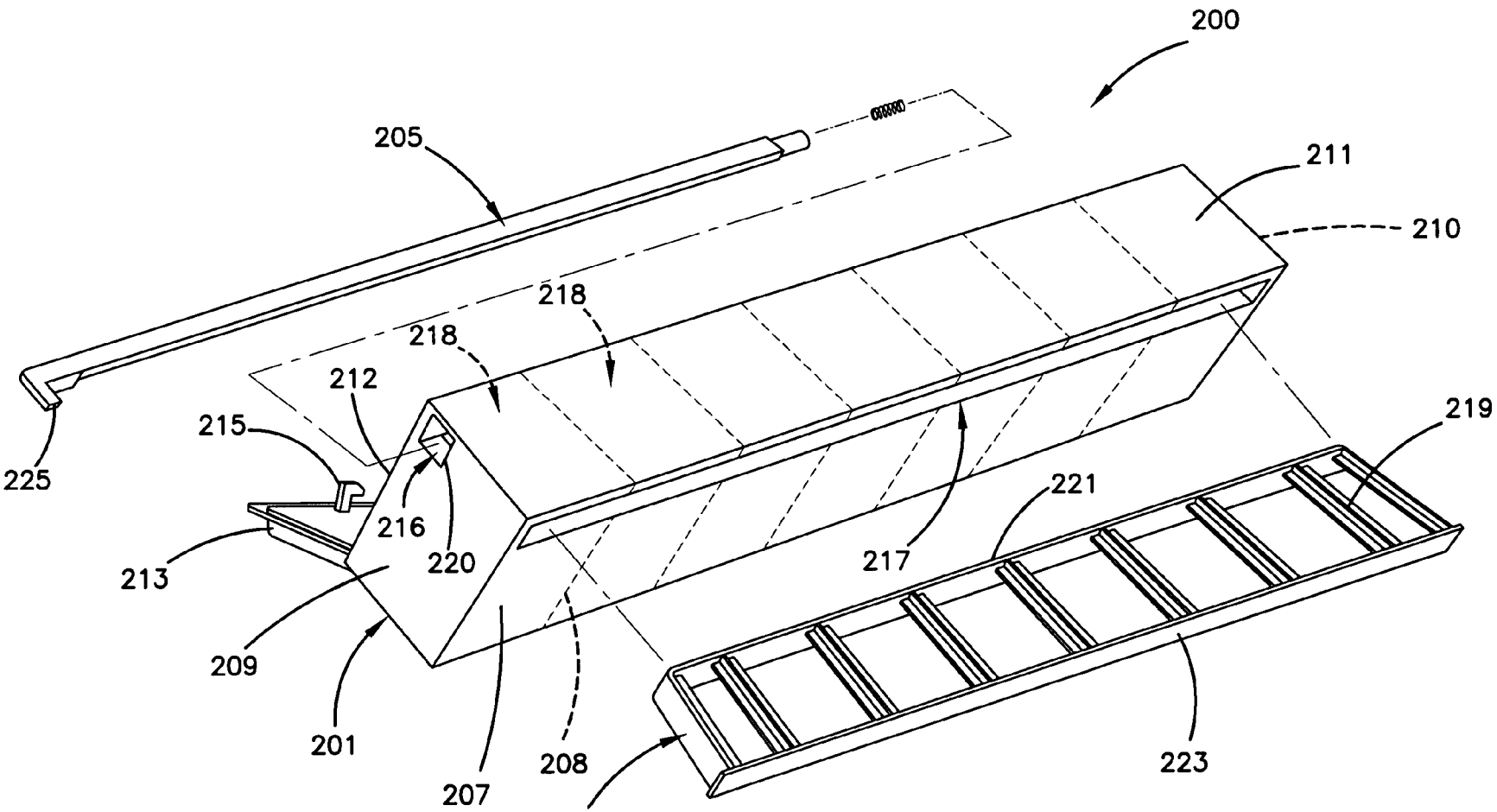
FIG. 8 is an exploded perspective view of another example seven-compartment storage device according to principles of the present invention.

FIG. 8 illustrates another example portable storage device 200 that includes a main body 201, a longitudinally extended locking engagement member 205 and a longitudinal support member 203. The main body 201 includes a bottom element 207, a first side element 209, a second side element 210, a front member 211, a top member 212, and a plurality of lid members 213. Inside the main body 201, a plurality of dividing elements 208 are located, thus forming a plurality of separate pill storage compartments 218 in the main body 201 that are disposed linearly.

Each of the plurality of lid members 213 is constructed and sized to close one of the separate compartments 218. Each lid member 213 includes a hook member 215. The hook members 215 are engageable by the locking engagement member 205 to lock the lid members 213 in a closed position.

To aid the engagement member 205 in engaging and disengaging the hook member 215, the support member 203 is inserted into the main body 201 through a narrow longitudinal slot or opening 217 formed in the bottom element 207. The support member 203 includes a top longitudinal rail member 221, a bottom longitudinal rail member 223, and a plurality of spaced, transverse support ribs 219 extending between the top and bottom longitudinal members 221 and 223. The support member 203 is inserted into the opening 217 of the main body 201 with the top rail member 221 first. When the support member 203 is inserted into the opening 217 the engagement between the ribs 219 and the interior wall surfaces of opening 217 causes the support member 203 to be frictionally retained inside the main body 201, but it can easily be removed by hand.

The engagement member 205 is laterally inserted into the main body through the side opening 216. The transverse portion 225 of the engagement member 205 fits within a recessed portion 220 in the side element 209. The top rail member 221 of the support member 203 is disposed below the engagement member 205, giving structural integrity to the device while retaining and supporting the engagement member 205.

Figure 9:
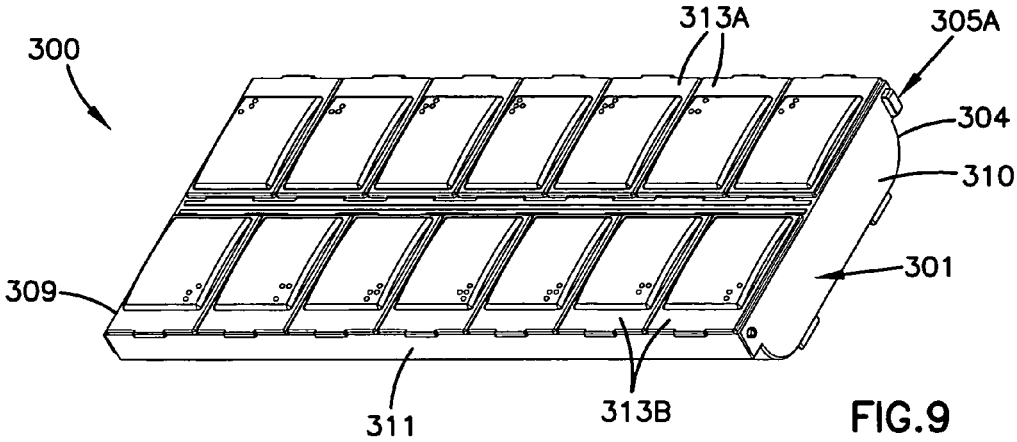
FIG. 9 is a perspective view of an example fourteen-compartment storage device having two separate locking mechanisms according to principles of the present invention.
Figure 10:
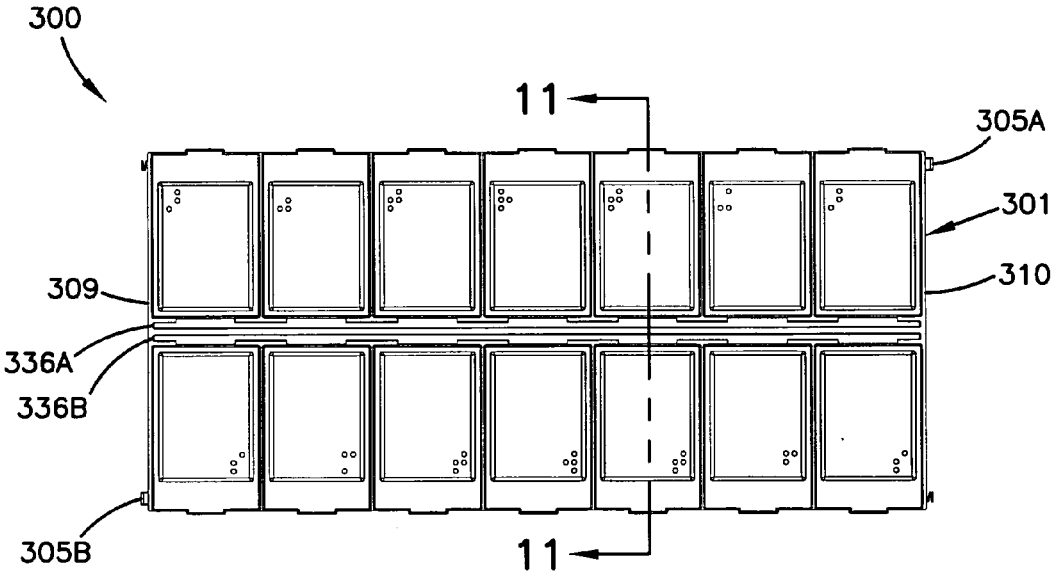
FIG. 10 is a top view of the storage device shown in FIG. 9.
Figure 11:
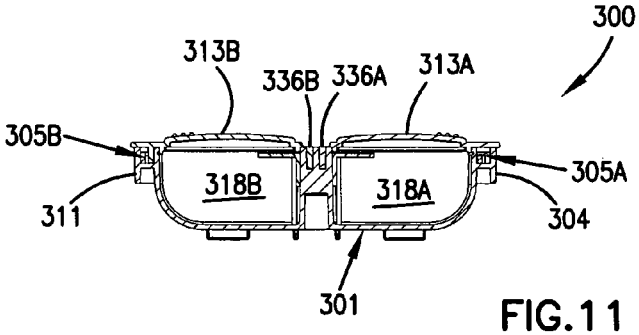
FIG. 11 is a cross-sectional view of the storage device shown in FIG. 10 taken along cross-sectional indicators 11-11.

Referring now to FIGS. 9-11, another exemplary portable storage device 300 in the form of a fourteen compartment pill container is shown and described. The device 300 includes a main body 301 and a longitudinally extended locking engagement member 305A, 305B that are associated with separate rows of lid members 313A, 313B. The main body 301 includes a bottom element 307, a first side element 309, a second side element 310, a front member 311, a back member 304, a top member 312, and the rows of lid members 313A, 313B.

Inside the main body 301, a plurality of dividing elements 308 are located, thus forming separate rows of pill storage compartments 318A, 318B in the main body 301. Each of the plurality of lid members 313A, 313B is constructed and sized to close one of the respective separate compartments 318A, 318B. Each lid member 313A, 313B includes a hook member 315 extending perpendicularly beneath the lid member 313A, 313B. The hook members 315 are engageable by the locking engagement member 305 to lock the lid members 313A, 313B in a closed position. Likewise, by moving the locking engagement member 305, the hook members 315 are disengaged from the locking engagement member 305 so that the lids can move to an open position.

The lids 313A, 313B are coupled to the main body 301 with respective hinge assemblies 336A, 336B. Each hinge assemblies 336A, 336B includes a continuous length of material that engages within a recess formed in the main body 301 (see the cross-section of FIG. 11), and a plurality of living hinges that are coupled to respective separate lids 313A, 313B.

The locking engagement members 305A, 305B are accessible from opposing sides 310, 309 of the main body 301. As a result, the locking engagement members 305A, 305B are always positioned on the left hand side of a user when the user is preparing to open the lids 313A, 313B towards the user using their right hand. In other embodiments, the locking engagement members may be accessible on the same side of the main body (e.g., see device 500 in FIGS. 15-18 described below).

Figure 12:
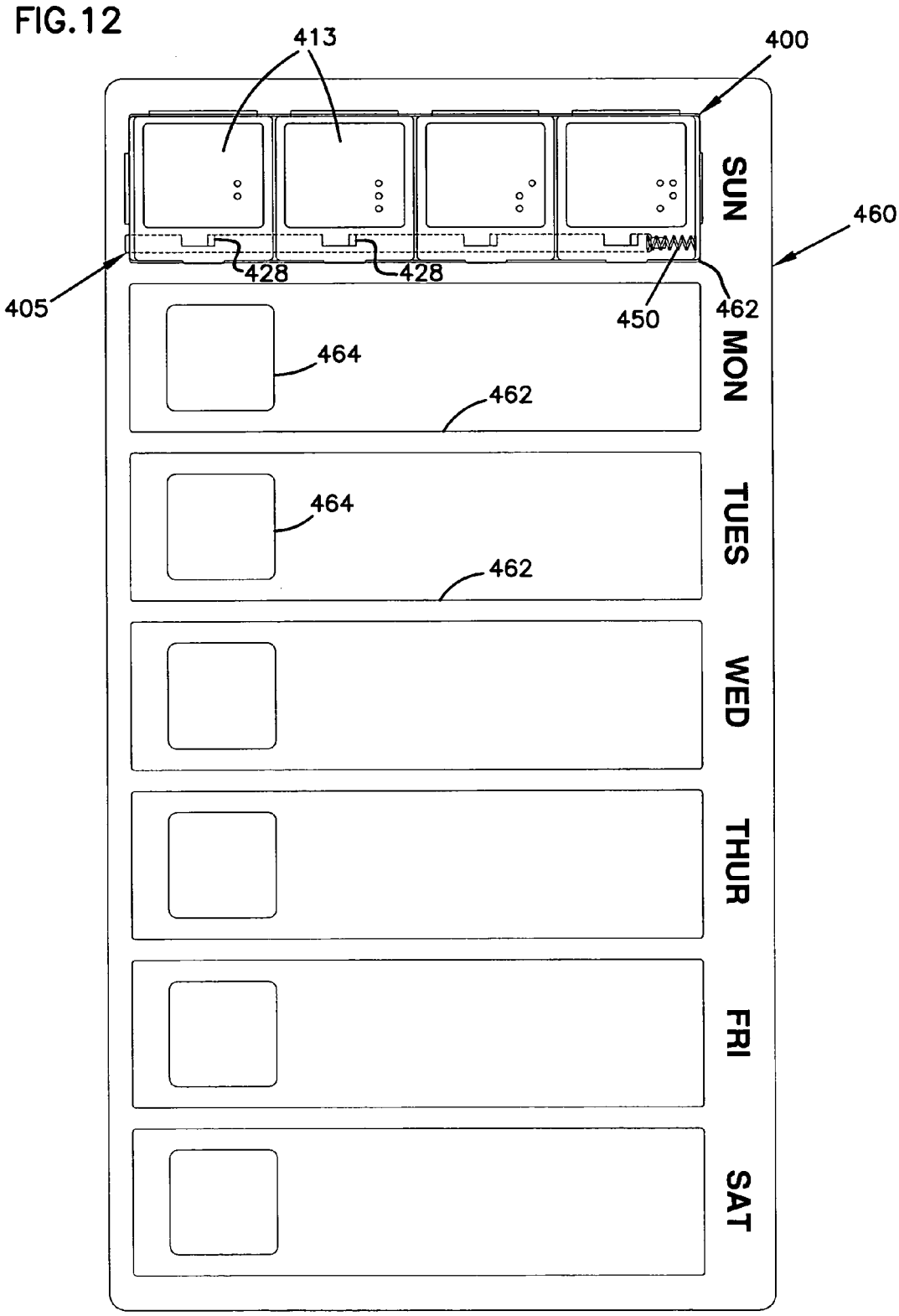
FIG. 12 is a top view of another storage device assembly according to principles of the present invention having at least one removable four-compartment member.
Figure 13:
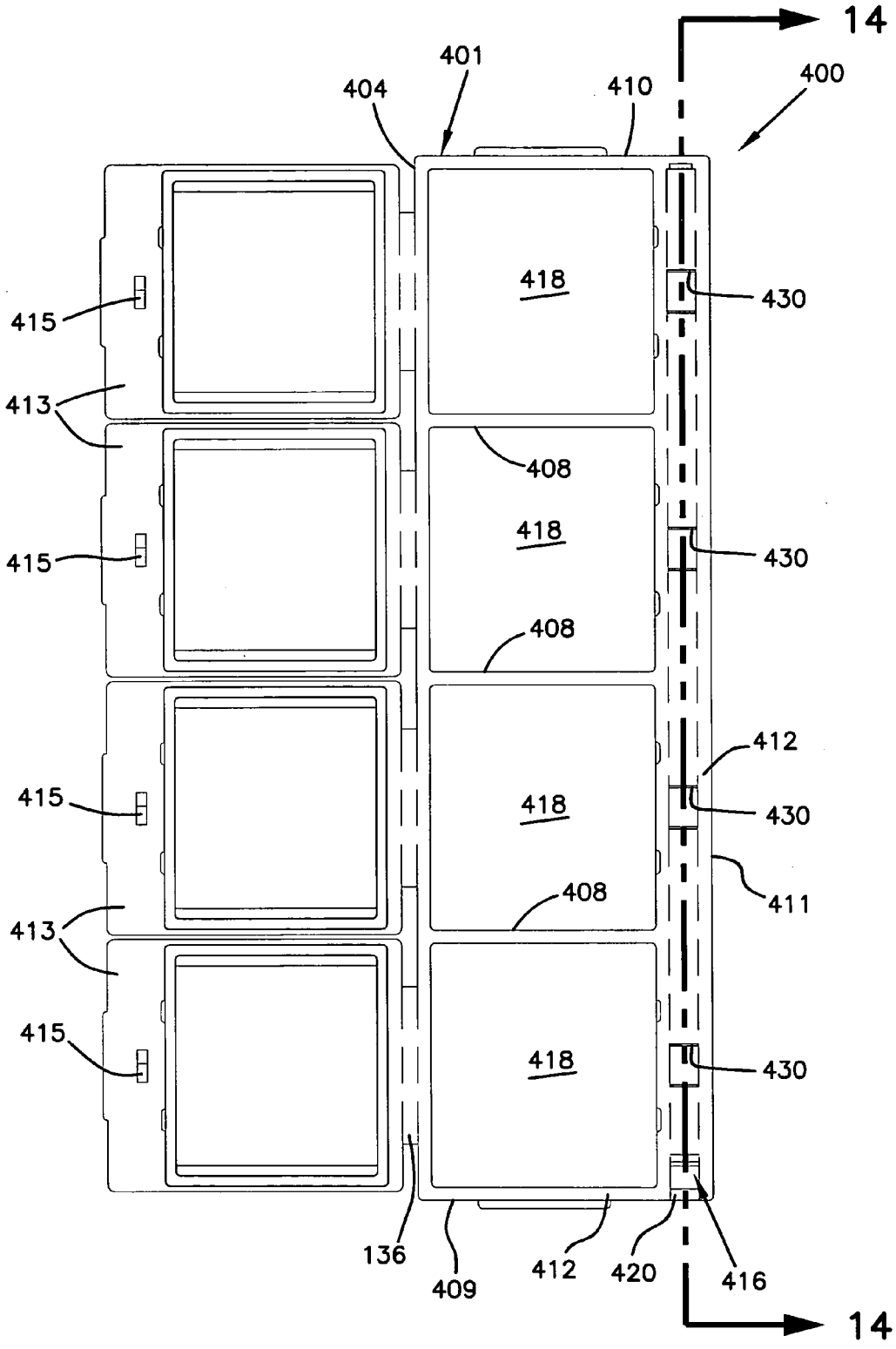
FIG. 13 is a top view of the removable four-compartment member shown in FIG. 12 having the lids in an open position.
Figure 14:
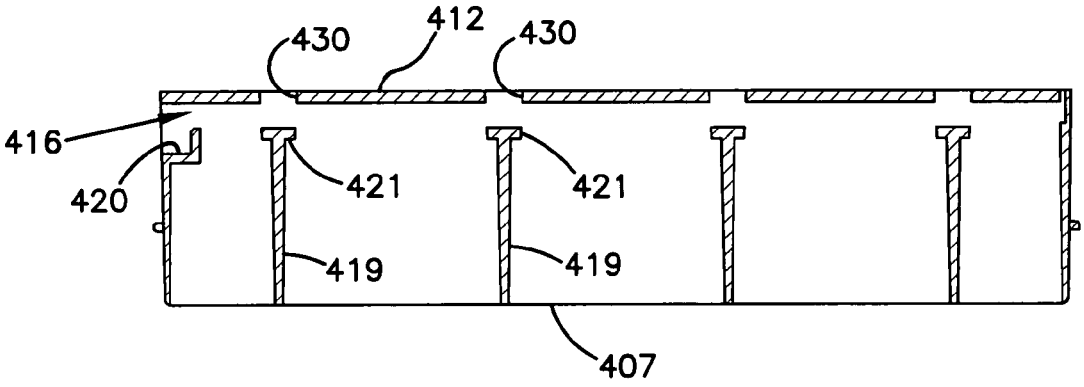
FIG. 14 is a cross-sectional view of the removable four-compartment member shown in FIG. 13 taken along cross-sectional indicators 14-14.
Figure 15:
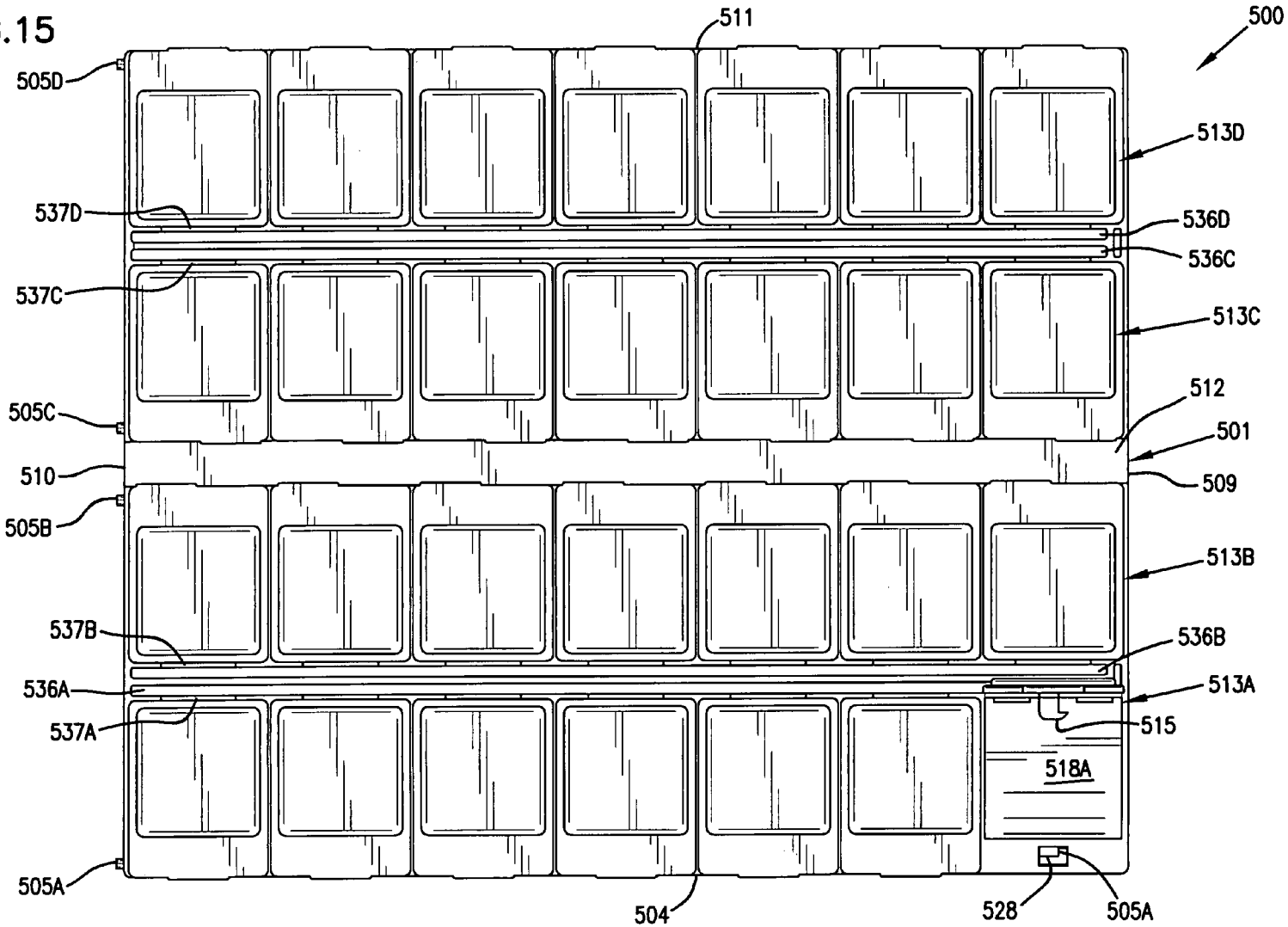
FIG. 15 is a top view of a twenty-eight compartment storage device according to principles of the present invention wherein the device includes four separate locking mechanisms accessible along the same side.

Referring now to FIGS. 12-14, another exemplary portable storage device 400 in the form of a four compartment pill container positioned in a retaining tray 460 is shown and described. The device 400 has similar features to the device 100 described above with exception to the number of compartments defined by the devices. The device 400 includes a main body 401 and a longitudinally extended locking engagement member 405. The main body 401 includes a bottom element 407, a first side element 409, a second side element 410, a front member 411, a back member 404, a top member 412, and a plurality of lid members 413.

Inside the main body 401, a plurality of dividing elements 408 are located, thus forming separate rows of pill storage compartments 418A, 418B in the main body 401. Each of the plurality of lid members 413 is constructed and sized to close one of the respective separate compartments 418. Each lid member 413 includes a hook member 415 extending perpendicularly beneath the lid member 413. The hook members 415 are engageable by the locking engagement member 405 to lock the lid members 413 in a closed position. Likewise, by moving the locking engagement member 405, the hook members 415 are disengaged from the locking engagement member 405 so that the lids can move to an open position.

The lids 413 are coupled to the main body 401 with hinge members 436. The hinge members 436 are preferably living hinges that are continuous with the main body 401 and lids 413.

The engagement member 405 is supported within opening 416 by a plurality of support platforms 421 (see FIG. 14). Support ribs 419 support the platforms 421. The shape of the platforms 421 and ribs 419 may vary slightly for purposes of molding the platforms 421 and ribs 419 directly into the main body 401. An end of the engagement member 405 may be exposed for engagement and positioned within a recessed portion 420 that is formed in the first side element 409.

When the lid members 413 are in the closed position, the hook members 415 extend through top openings 430 in the front member 411 of the main body. The hook members 415 also extend through gaps or openings 428 formed in the front edge of engagement member 405. The hook members 415 engage the engagement member 405, retaining or locking the lid members 413 in the closed position. A biasing member 450 is positioned within the opening 416 between an end of the engagement member 405 and the main body 401. The biasing member 450 biases the engagement member 405 into a position in which the hook members 415 are engaged to lock the lids 413 closed.

The tray 460 includes a plurality of recesses 462 sized to receive a separate device 400 in each recess. The tray 460 may include a recess for holding a device 400 for each day of the week for a total of at least seven devices 400. The tray 460 may also include an aperture or opening 464 that permits engagement with the bottom element 407 when a device 400 is mounted in a recess 462 to help remove the device 400 from the recess 462. The device 400 may be held within the recess 462 with any desired connection means such as, for example, a snap-fit or interference fit.

Referring now to FIGS. 15-18, another exemplary portable storage device 500 in the form of a twenty-eight compartment pill container is shown and described. The device 500 includes a main body 501 and a plurality of longitudinally extended locking engagement member 505A, 505B, 505C, 505D that are associated with separate rows of lid members 513A, 513B, 513C, 513D. The main body 501 includes a bottom element 507, a first side element 509, a second side element 510, a front member 511, a back member 504, a top member 512, and the rows of lid members 513A, 513B, 513C, 513D.

Figure 16:
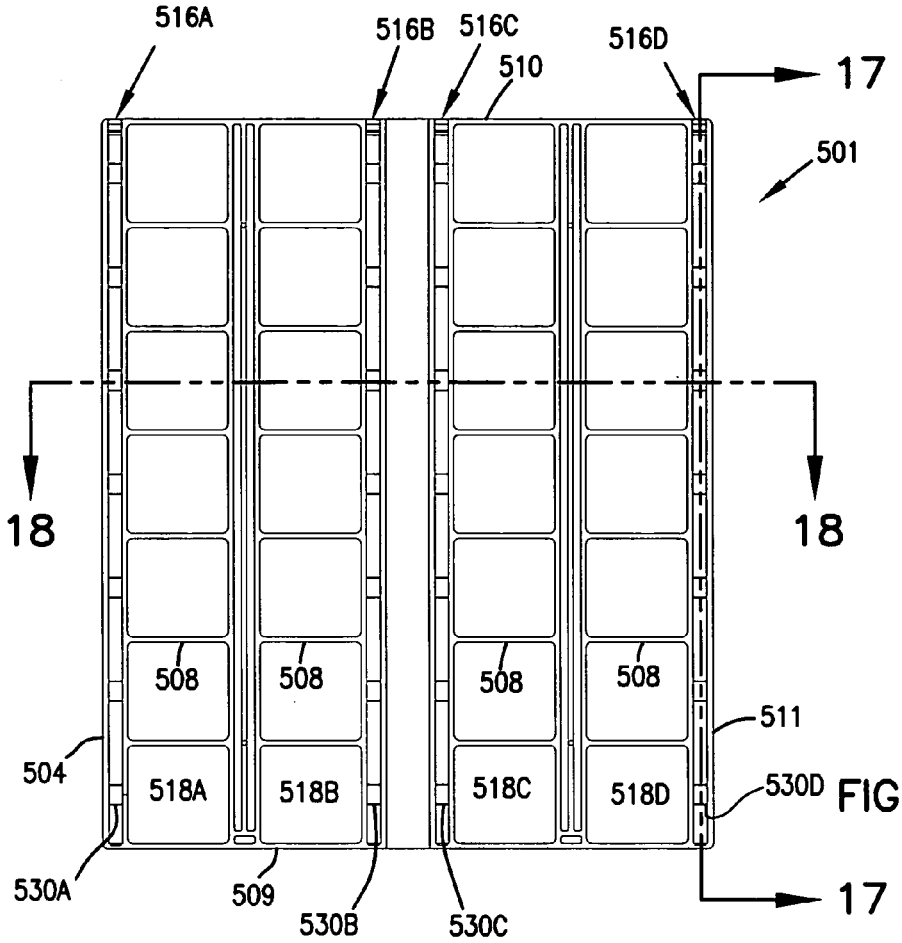
FIG. 16 is a top view of the storage device housing shown in FIG. 15 with the lids and hinges removed.
Figure 18:
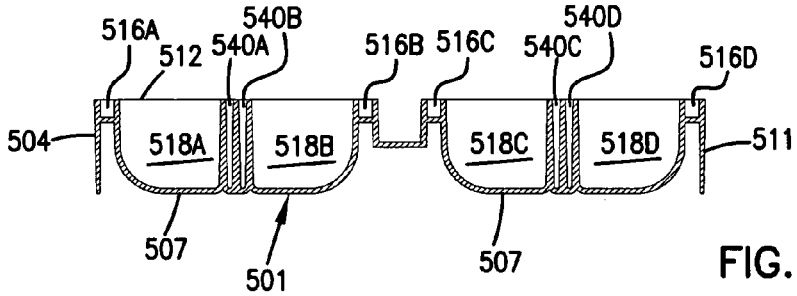
FIG. 18 is a cross-sectional view of the storage device housing shown in FIG. 16 taken along cross-sectional indicators 18-18.
Figure 17:
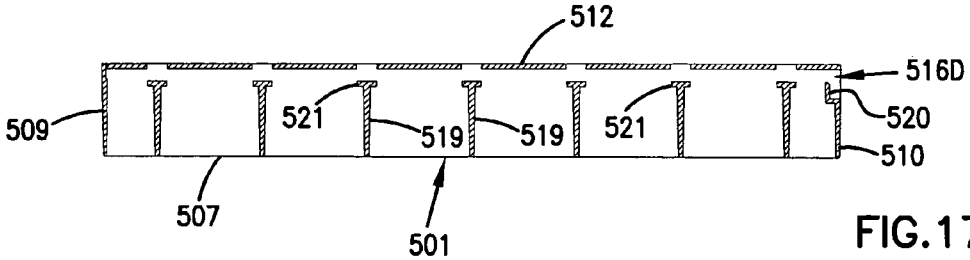
FIG. 17 is a cross-sectional view of the storage device housing shown in FIG. 16 taken along cross-sectional indicators 17-17.
Figure 19:
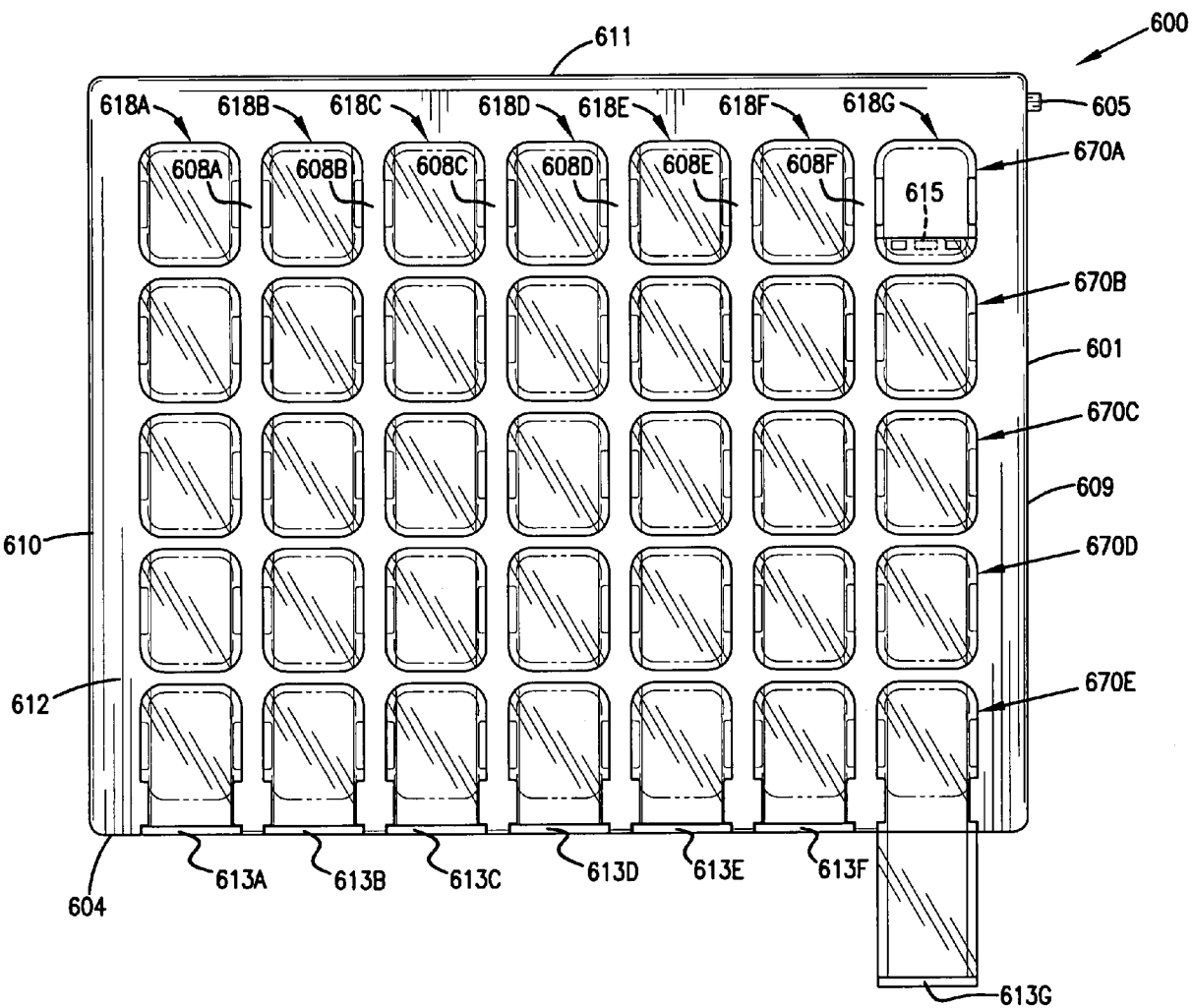
FIG. 19 is a top view of another example storage device according to principles of the present invention having lockable sliding lids and thirty-five storage compartments.
Figure 20:
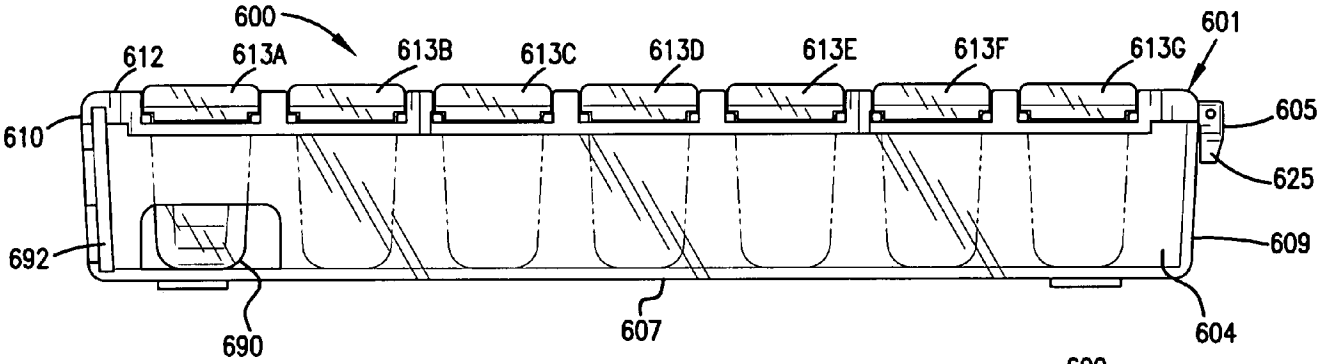
FIG. 20 is a front view of the example storage device shown in FIG. 19.
Figure 21:
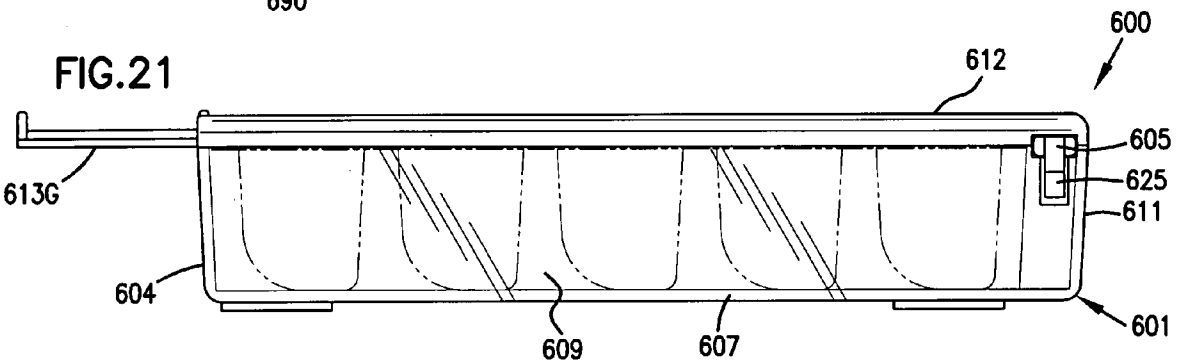
FIG. 21 is a first side view of the example storage device shown in FIG. 19 with one of the lids slid into a partially open position.

FIGS. 16-18 illustrate the device 500 without the lid members 513A, 513B, 513C, 513D. Inside the main body 501, a plurality of dividing elements 508 are located, thus forming separate storage compartments arranged in rows of pill storage compartments 518A, 518B, 518C, 518D. Each of the plurality of lid members 513A, 513B, 513C, 513D is constructed and sized to close one of the respective separate compartments 518A, 518B, 518C, 518D (see example open lid 513D in FIG. 15). Each lid member 513A, 513B, 513C, 513D includes a hook member 515 that extends perpendicularly beneath the lid member 513A, 513B, 513C, 513D. The hook members are engageable by the locking engagement member 505A, 505B, 505C, 505D to lock the lid members 513A, 513B, 513C, 513D in a closed position. Likewise, by moving the locking engagement member 505A, 505B, 505C, 505D, the hook members are disengaged from the locking engagement member 505A, 505B, 505C, 505D so that the lids can move to an open position.

The lids 513A, 513B, 513C, 513D are coupled to the main body 501 with respective hinge assemblies 536A, 536B. Each hinge assemblies 536A, 536B, 536C, 536D includes a continuous length of material that engages within a recess 540A, 540B, 540C, 540D (see FIG. 18) formed in the main body 501, and a plurality of living hinges 537A, 537B, 537C, 537D that are coupled to respective separate lids 513A, 513B, 513C, 513D (see FIG. 15). The locking engagement members 505A, 505B, 505C, 505D are accessible along the same side 510 of the main body 501. As a result, the device 500 does not have to be rotated 180° for the user to access and actuate the locking engagement members 505A, 505B with the same hand.

The engagement members 505A, 505B, 505C, 505D are supported within openings 516A, 516B, 516C, 516D by a plurality of support platforms 521 (see FIGS. 16 and 17). Support ribs 519 support the platforms 521. The shape of the platforms 521 and ribs 519 may vary slightly for purposes of molding the platforms 521 and ribs 519 directly into the main body 501. An end of each engagement member 505A, 505B, 505C, 505D may be exposed for engagement and movable within a separate recess portion 520 that is formed in the first side element 509.

When the lid members 513A, 513B, 513C, 513D are in the closed position, the hook members 515 of the lids 513A, 513B, 513C, 513D extend through top openings 530A, 530B, 530C, 530D in the front member 511 of the main body. The hook members 515 also extend through gaps or openings 528 (see FIG. 15 for example opening 528 in member 505A) formed in the front edge of engagement members 505A, 505B, 505C, 505D. The hook members 515 engage the engagement members 505A, 505B, 505C, 505D, retaining or locking the lid members 513A, 513B, 513C, 513D in the closed position. A biasing member (not shown) is positioned within the main body 501 in contact with an end of the corresponding engagement member 505A, 505B, 505C, 505D. The biasing member biases the corresponding engagement member 505A, 505B, 505C, 505D into a position in which the hook members of the lids 513A, 513B, 513C, 513D are engaged to lock the lids 513A, 513B, 513C, 513D closed.

Referring now to FIGS. 19-22, another exemplary portable storage device 600 in the form of a thirty-five compartment pill container is shown and described. The device 600 includes a main body 601 and a longitudinally extended locking engagement member 605 that is associated with a plurality of lid members 613A-G. The main body 601 includes a bottom element 607, a first side element 609, a second side element 610, a front member 611, a back member 604, a top member 612, and the lid members 613A-G.

Figure 22:
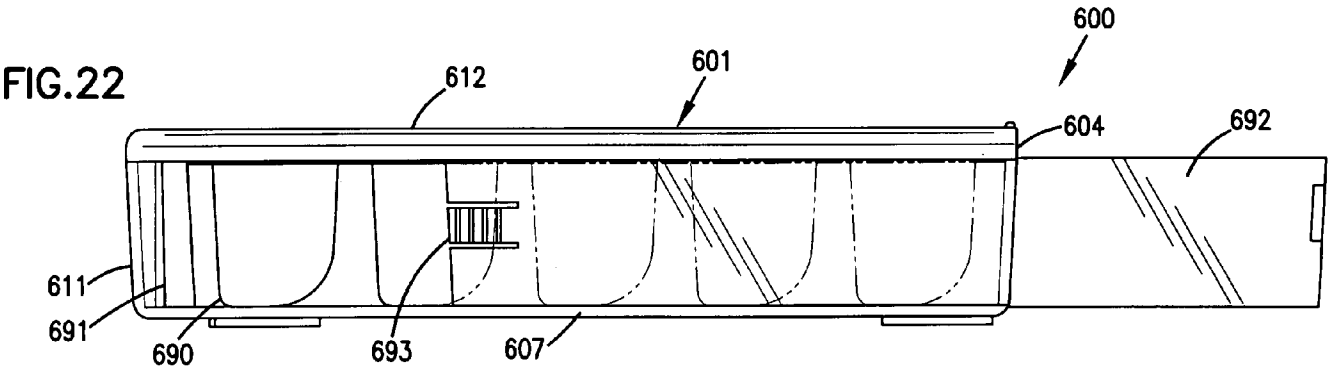
FIG. 22 is a second side view of the example storage device shown in FIG. 19 with a side lid slid into a partially open position to remove a blister pack from the device.

A blister pack 690 having a compartment aligned with each of the openings in top panel 612 can be inserted into the main body 601 through a side opening 691 in second side 610 (see FIG. 22). The opening 691 can be closed with a lid 692. The lid 692 can slide between open and closed positions and include a locking feature 693 at an end thereof to hold the lid 692 in a closed position. The pack 690 may include a different number of compartments than the number of openings formed in the top member 612.

A plurality of rows of openings 618A-G are formed in the top member 612. The rows of openings 618A-G are separated by dividers 608A-H that each include a track structure that retain the lid members 613A-G and permit sliding of the lid members 613A-G between opened and closed positions. The openings in top member 612 also define columns of openings 670A-E. The rows 618A-G and columns 670A-E provide a pill dispensing configuration for a variety of pill regimens, such as, for example, a regime of four times a day, seven days a week with an extra miscellaneous column of openings, or a regime of once a day for a month with several extra openings depending on the number of days in the month.

Each lid member 613A-G includes a hook member 615 (see FIG. 19) extending perpendicularly beneath the lid member 613A-G. The hook members are engageable by the locking engagement member 605 to lock the lid members 613A-G in a closed position. Likewise, by moving the locking engagement member 605, the hook members are disengaged from the locking engagement member 605 so that the lids can slide into a position that permits access to one of the openings in a corresponding row of openings 618A-G.

The locking engagement member 605 is accessible along the side 609 of the main body 601. The locking engagement member 605 includes a transverse member 625 for engagement by a user to move the locking engagement member 605 against a biasing member positioned within the main body 601 to unlock the lids 613A-G. When the lid members 613A-G are in the closed position, the hook members 615 of the lids 613A-G are positioned adjacent to the locking engagement member 605.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A lockable pill container comprising:

a main body defining a plurality of separate compartments, each compartment having an open top;

a lid member associated with each of the compartments, each lid member being sized and constructed to overlie the open top of the associated compartment and including an engageable first locking member that is sized and constructed to project into the main body when the lid member is in its closed position;

a second locking member carried by the main body and moveable between a first position in which the second locking member interlockably engages the first locking members of closed lid members and a second position in which the second locking member is disengaged from the first locking members, the second locking member including a user engagement surface at a first end, the user engagement surface being configured for engagement by a user to move the second locking member between the first and second positions; and a biasing member positioned between a second end of the second locking member and the main body, the biasing member being engageable with the second locking member by moving the second locking member.

2. The lockable pill container of claim 1, wherein the second locking member further comprises an actuating member defining the engagement surface.

3. The lockable pill container of claim 2, wherein the actuating member includes a rigid member that extends in a direction substantially perpendicular to a direction along a length of the second locking member.

4. The lockable pill container of claim 1, wherein the main body is elongated and the compartments are linearly arranged.

5. The lockable pill container of claim 1, wherein the biasing member provides biasing forces to bias the second locking member into the first position.

6. The lockable pill container of claim 1, wherein the compartments are arranged in a matrix, the matrix comprising rows of compartments, and a separate locking member is associated with each row.

7. The lockable pill container of claim 1, further comprising a hinge configured to couple each lid member to the main body and permit the associated lid member to be moved between open and closed positions.

8. The lockable pill container of claim 6, wherein one row of compartments comprises a first colored material and the other row of compartments includes a second colored material different than the first colored material.

9. The lockable pill container of claim 6, wherein a lid covers the open tops of the compartments in a row of compartments, the lockable pill container comprising a separate lid for each row, and a single locking member locks all of the lids.

10. A method of forming a lockable pill container comprising:

forming a main body having a plurality of separate compartments, each compartment having an open top;

forming a lid member for each of the compartments, each lid member being sized and constructed to overlie the open top of the associated compartment, and including an engageable first locking member that is sized and constructed to project into the main body when the lid member is in a closed position;

positioning a second locking member at least partially within the main body and moveable between a first position in which the second locking member interlockably engages the first locking members of closed lid members and a second position in which the second locking member is disengaged from the first locking members;

coupling a biasing member at a first end of the second locking member, the biasing member biasing the second locking member into the first position; and forming an engagement surface at a second end of the second locking member, the engagement surface configured for engagement by a user to move the second locking member between the first and second positions thereby actuating the biasing member.

11. The method of claim 10, further coupling the lid members to the main body with a living hinge.

12. The method of claim 10, further comprising providing a button member at the second end of the second locking member, the button member defining the engagement surface.

13. The method of claim 10, further comprising forming at least one support member integrally with the main body to support the second locking member as the second locking member moves between the first and second positions.

14. The method of claim 10, further comprising forming a support member that is configured for removable engagement with the main body, the support member being configured to support the second locking member as the second locking member moves between the first and second positions.

15. A method of using a lockable pill container comprising:

providing a main body having a plurality of compartments, a plurality of lid members, a first locking member associated with each lid member, and a second locking member having a biasing member coupled at one end and a user engagement surface at an opposing end; the biasing member being between said one end of the second locking member and the main body;

closing at least one of the lids to engage the first and second locking members;

engaging the user engagement surface to move the second locking member against the biasing forces of the biasing member, thereby disengaging the first and second locking members; and opening at least one lid.

16. The method of claim 15, wherein the main body is elongated and the compartments are arranged in a matrix, the matrix comprising rows and columns, and a separate locking member is associated with each row.

17. The method of claim 15, further comprising integrally forming at least one support member in the main body to support the second locking member as the second locking member moves between the first and second positions.

18. The method of claim 15, wherein the second locking member further comprises an actuating member defining the engagement surface, the method further comprising positioning the actuating member at the opposing end, wherein engaging the actuating member moves the second locking member against biasing forces of the biasing member.

19. A lockable pill container, comprising:

a main body defining a plurality of compartments;

a plurality of lid members moveable relative to the compartments between a closed position at least partially covering an opening into the compartments and an open position, each lid member including a first engagement member that extends into the main body when the lid member is in the closed position;

an elongate second engagement member configured to move between a first position engaging the first engagement members and a second position disengaged from the first engagement members; the second engagement member including a first end and a user engagement surface at a second end; and a biasing member positioned between the first end of the second engagement member and the main body, the biasing member providing a biasing force that biases the second engagement member into the first position.

20. The container of claim 19, wherein the user engagement surface includes a contact surface at the second end of the second engagement member, the contact surface being configured for contact by a user to move the second engagement member against the biasing force.

* * * * *